US008371541B2

(12) United States Patent
Eichhorn et al.

(10) Patent No.: US 8,371,541 B2
(45) Date of Patent: Feb. 12, 2013

(54) PORTABLE TOOL STAND

(75) Inventors: Eugene G. Eichhorn, Pinckney, MI (US); Joseph W. Pawlow, Redford, MI (US); Jeffrey Van Cleave, Troy, MI (US)

(73) Assignee: Van Mark Products Corporation, Farmington Hills, MI (US)

( * ) Notice: Subject to any disclaimer, the term of this patent is extended or adjusted under 35 U.S.C. 154(b) by 0 days.

(21) Appl. No.: 13/073,316

(22) Filed: Mar. 28, 2011

(65) Prior Publication Data

US 2012/0248279 A1 Oct. 4, 2012

(51) Int. Cl.
*A47K 1/04* (2006.01)

(52) U.S. Cl. ..... 248/129; 248/440.1; 16/32; 16/35 R

(58) Field of Classification Search ..... 248/128, 248/129, 163.1, 165, 188.2, 440, 440.1, 649; 16/32 X, 34, 35 R X; 72/319, 455; 280/43.24
See application file for complete search history.

(56) References Cited

U.S. PATENT DOCUMENTS

| | | | | |
|---|---|---|---|---|
| 131,239 | A | 9/1872 | Adler et al. | |
| 516,026 | A | 3/1894 | Seaver | |
| 934,701 | A | 9/1909 | Swanson | |
| 1,091,290 | A * | 3/1914 | Carr | 108/32 |
| 1,147,458 | A | 7/1915 | Steely | |
| 1,724,215 | A | 8/1929 | Moran | |
| 1,975,857 | A | 10/1934 | McKenney | |
| 2,181,566 | A * | 11/1939 | Jensen | 72/319 |
| 2,343,441 | A | 3/1944 | Babcock et al. | |
| 2,434,028 | A | 1/1948 | Wieland | |
| 3,260,533 | A * | 7/1966 | Ryder | 280/43.1 |
| 3,937,343 | A | 2/1976 | Spulak | |
| 4,008,507 | A * | 2/1977 | Smith | 16/34 |
| 4,155,386 | A | 5/1979 | Alessio | |
| D252,388 | S | 7/1979 | FJells-Jensen | |
| 4,223,881 | A | 9/1980 | Hickman | |
| 4,415,149 | A | 11/1983 | Rees | |
| 4,713,957 | A | 12/1987 | Eder et al. | |
| D304,650 | S | 11/1989 | Price | |
| 4,909,491 | A | 3/1990 | Cheng | |
| 5,067,535 | A | 11/1991 | Wolff | |
| 5,105,862 | A | 4/1992 | Skinner et al. | |
| 5,320,150 | A | 6/1994 | Everts et al. | |
| 5,582,055 | A | 12/1996 | Chubb et al. | |
| 5,651,298 | A | 7/1997 | Break et al. | |
| 5,681,034 | A | 10/1997 | Noniewicz | |

(Continued)

FOREIGN PATENT DOCUMENTS

| | | | |
|---|---|---|---|
| CH | 403677 | A | 11/1965 |
| GB | 2206069 | A | 12/1988 |

OTHER PUBLICATIONS

Van Mark Advertisement—Mark IV Industrial Portable Bending Brake, circa 2000.

*Primary Examiner* — Gwendolyn W Baxter
(74) *Attorney, Agent, or Firm* — Brooks Kushman P.C.

(57) ABSTRACT

A portable tool stand assembly includes a pair of wheels that are mounted on an axle that is received in a bracket plate. The bracket plate defines a J-shaped slot that has a mobility position in which the wheels are lowered relative to the tool stand assembly to permit the tool stand assembly to be wheeled into position. The wheels may be shifted to a work position in which the wheels are raised relative to the tool stand assembly with feet provided on legs engaging the ground and supporting the tool stand assembly.

11 Claims, 5 Drawing Sheets

U.S. PATENT DOCUMENTS

| | | | |
|---|---|---|---|
| 5,743,129 | A | 4/1998 | Chubb et al. |
| 5,927,436 | A | 7/1999 | Schutz |
| 6,070,696 | A | 6/2000 | Chubb et al. |
| 6,085,569 | A | 7/2000 | Chubb et al. |
| D437,864 | S | 2/2001 | Van Cleave et al. |
| 6,389,864 | B1 * | 5/2002 | Chubb et al. ..... 72/319 |
| 6,435,460 | B1 | 8/2002 | Van Cleave et al. |
| 6,854,314 | B2 | 2/2005 | Cleave et al. |
| 2010/0024621 | A1 | 2/2010 | Van Cleave et al. |

* cited by examiner

PORTABLE TOOL STAND

TECHNICAL FIELD

The present invention relates to portable tool stand assemblies that are used to support a tool on a floor or on the ground in a field service operation.

BACKGROUND

Background art examples of portable tool stands are disclosed in U.S. Pat. Nos. 5,582,055; 6,085,569; and 6,435,460.

SUMMARY

According to one aspect of the present invention, a portable tool stand is provided with wheels that are mounted to be switched between a mobile position and a work position. In the mobile position, the portable tool stand may be rolled to a desired location. The wheels may then be repositioned to prevent the portable tool stand from rolling on the wheels and can instead be supported on feet that are attached to the legs of the portable tool stand.

According to another aspect of the invention, a stabilizer may be assembled to and detached from the portable tool stand quickly and easily without tools. The stabilizing assembly includes a foot brace that is connected to the portable tool stand by side rails that attach to right and left leg assemblies of the portable tool stand.

The above aspects of the disclosure will be better understood in view of the attached drawings and the following detailed description of the illustrated embodiments.

DETAILED DESCRIPTION

A detailed description of the illustrated embodiments of the present invention are provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Figure 1:
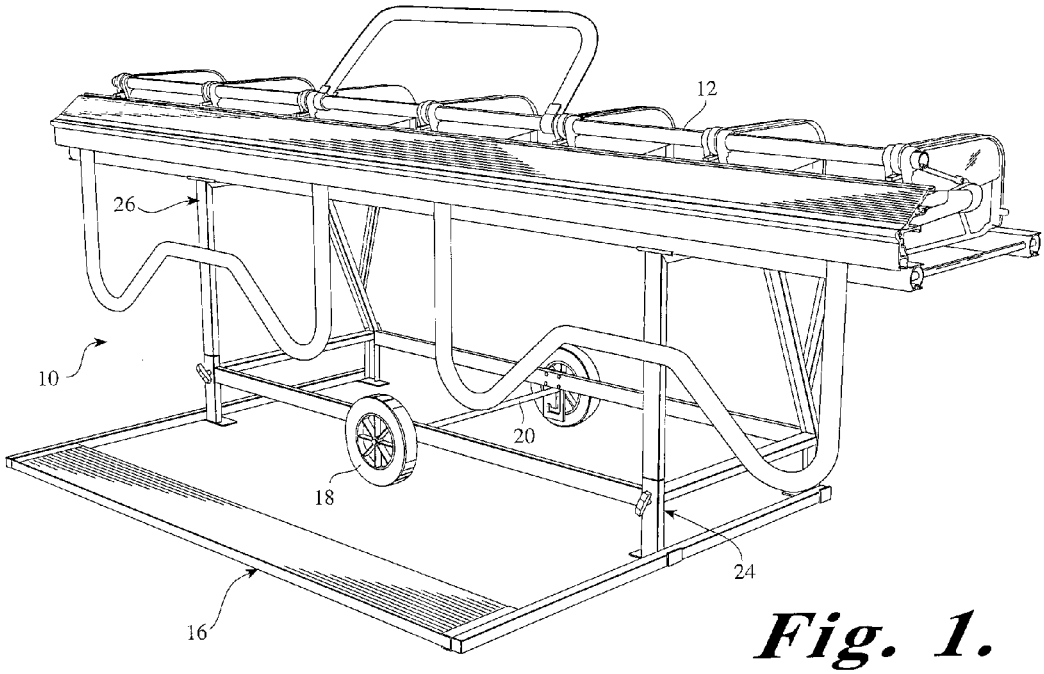
FIG. 1 is a perspective view of a sheet metal bending brake attached to a portable tool stand made according to one embodiment of the present invention.
Figure 2:
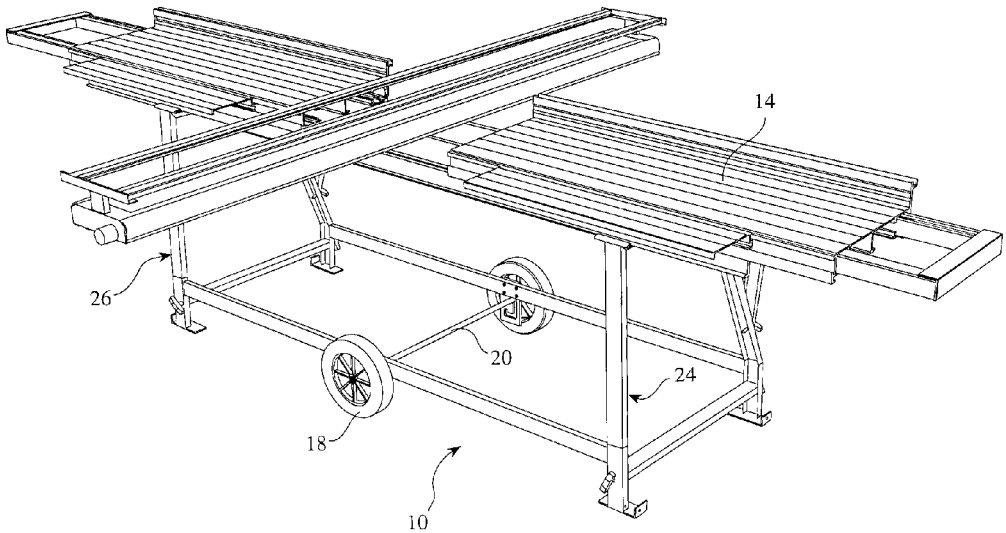
FIG. 2 is a perspective view of a saw table connected to a portable tool stand made according to another embodiment of the present invention.
Figure 3:
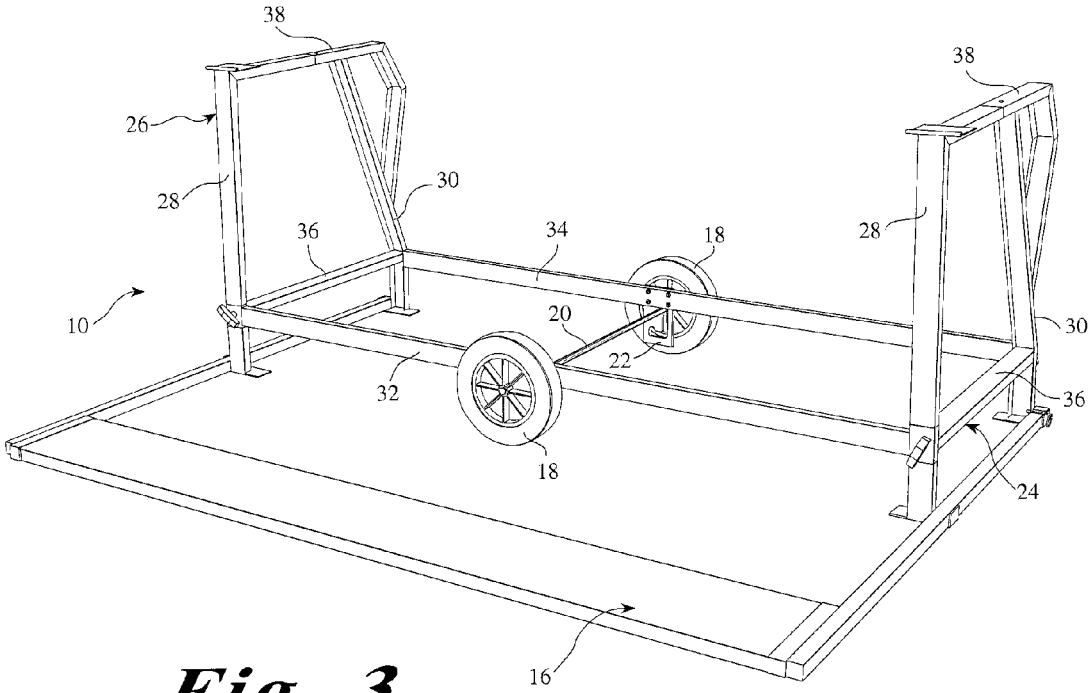
FIG. 3 is a perspective view of a portable tool stand.

Referring generally to FIGS. 1-3, a portable tool stand assembly 10 is illustrated in FIG. 1 with a sheet metal bending brake 12, or tool, disposed on top of the stand assembly 10. With specific reference to FIG. 2, an alternative embodiment is shown wherein a saw table 14 is assembled to the portable tool stand assembly 10.

A stabilizing assembly 16 is shown attached to the portable tool stand assembly 10 in FIGS. 1 and 3. The stabilizing assembly 16 is particularly beneficial when attached to a sheet metal bending brake 12 since an operator standing on the stabilizing assembly 16 stabilizes the sheet metal bending brake 12 while bending a piece of sheet metal. In the saw table embodiment of FIG. 2, there is less need for a stabilizing assembly 16. Many other types of tools may be attached to the tool stand assembly 10.

A pair of wheels 18 are attached to an axle 20. A bracket plate 22 is secured to the tool stand assembly 10 in a central location between a right leg assembly 24 and a left leg assembly 26. The wheels 18 and axle 20 may be moved relative to the bracket 22 between a mobility position in which the stand assembly 10 and tool 12 may be easily rolled along a supporting surface with the weight of the stand assembly 10 and tool 12 being balanced over the axle 20. The location of the bracket plate 22 is shown to be centered relative to the right and left leg assemblies 24 and 26, but it should be understood that the bracket plates 22 could be offset toward the right leg assembly 24 or the left leg assembly 26 by a substantial amount. However, the bracket plates 22 should be located at an intermediate location between the leg assemblies 24 and 26 to optimize mobility.

With more specific reference to FIG. 3, the right leg assembly 24 and left leg assembly 26 each include a front leg 28 and a rear leg 30. A front stretcher 32 extends between the front legs 28 and a rear stretcher 34 extends between the rear legs 30. Side stretchers 36 extend between the front leg 28 and the rear leg 30 of each of the right and left leg assemblies 24 and 26. A pair of tool support rails 38 are provided on the top end of the right and left leg assemblies 24 and 26. The sheet metal bending brake 12, saw table 14, or other tool may be attached to the tool support rails 38 by clamps or fasteners (not shown).

Figure 4:
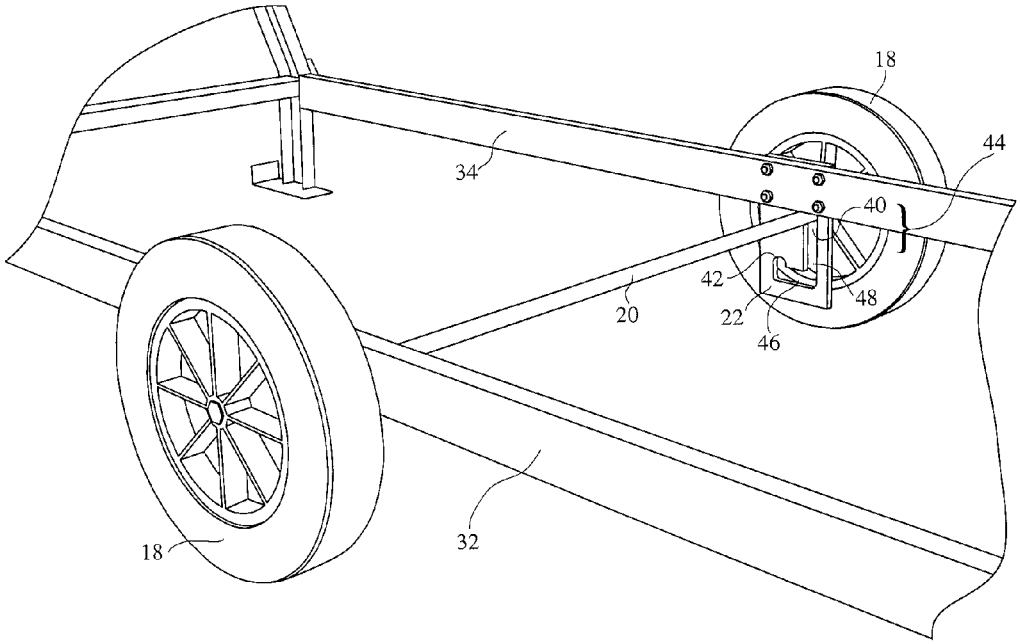
FIG. 4 is a fragmentary perspective view of wheels attached to an axle that is secured to the portable tool stand by a bracket.

Referring to FIG. 4, the structure of the bracket plate 22 will be described in more detail in conjunction with the wheels 18 and axle 20. A bracket plate 22 is assembled to the front stretcher 32 and a mirror image bracket plate 22 is attached to the rear stretcher 34. A J-shaped slot 40 is defined in the bracket plate 22. The J-shaped slot 40 defines the mobile position 42 which is on the lower end of the J-shaped slot 40. When the axle 20 is disposed in the mobile position 42, or lower end, the portable tool stand assembly 10 is raised so that the leg assemblies 24 and 26 do not contact the ground and the tool stand assembly 10 and tool 12 may be easily wheeled around over ground surfaces that may be smooth or even rough terrain. The balancing of the tool 12 over the axle 20 permits the tool 12 to be easily pivoted or repositioned with the weight of the tool stand assembly 10 and tool 12 being balanced.

A work position 44 is defined in the J-shaped slot 40 below an upper end of the J-shaped slot 40. As shown in FIG. 4, the axle 20 is disposed in the work position 44. In the work position, the lower end of the leg assemblies 24 and 26 engage the ground and secure the tool stand assembly 10 in place to provide a stable work surface. A horizontal transition area 46 and a vertical transition area 48 are provided between the mobile position 42 and the work position 44.

Figure 5:
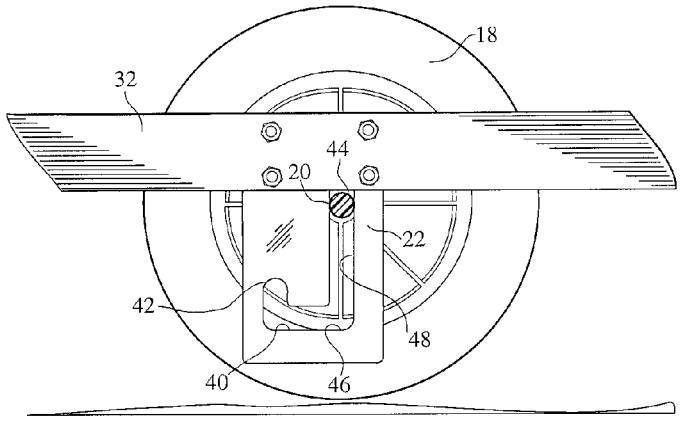
FIGS. 5-7 show a wheel mounted to an axle as it is moved from a work position to a mobile position.

The process of shifting between the work position 44 and the mobile position 42 will be described below with reference to FIGS. 5-7. Referring to FIG. 5, the axle 20 is shown in the work position 44 in which the wheel 18 is raised relative to the front stretcher 32. In the work position, the axle 20 may be located at any point in the vertical transition area 48 below the work position 44 provided that the leg assemblies 24 and 26 are on the ground.

Figure 6:
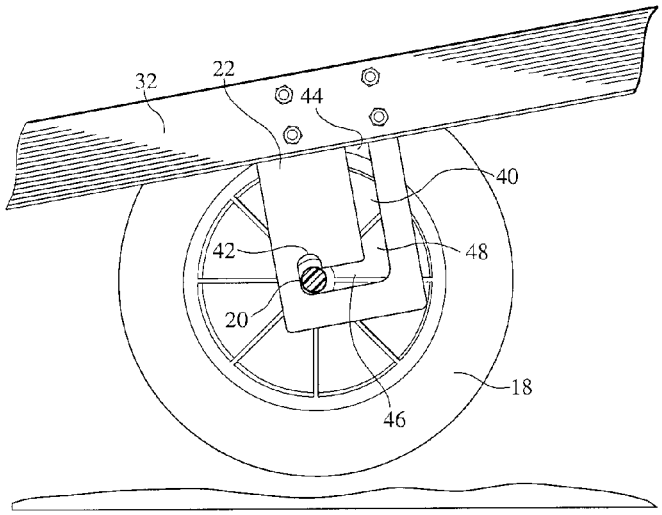

Referring to FIG. 6, the portable tool stand assembly 10 is shown lifted on one end which causes the axle 20 to move through the vertical transition area 48 of the J-slot 40 and then to the horizontal transition area 46 by force of gravity. Once the axle 20 is moved to the end of the horizontal transition area 46, it is positioned below the mobile position 42 at the lower end of the J-shaped slot 40.

Figure 7:
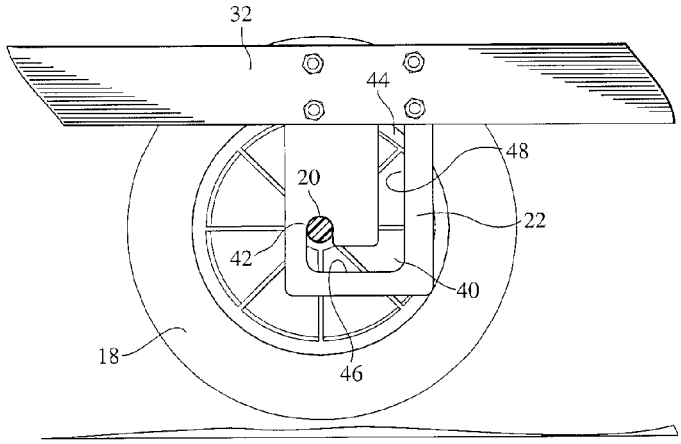

Referring to FIG. 7, the axle is now shown fully received in the mobile position 42 at the lower end of the J-shaped slot 40. The weight of the portable tool stand assembly 10 secures the axle 20 in place thereby allowing the tool stand assembly 10 to be wheeled about as the tool stand assembly 10 is raised completely off the ground and the weight of the tool stand assembly 10 and tool 12 is balanced over axle 20. To reverse the process of moving the axle to the work position 44, the opposite end of the portable tool stand assembly 10 is lifted so that the axle 20 traverses the horizontal transition area 46 until the axle 20 is disposed below the vertical transition area 48. At this point, the weight of the portable tool stand assembly 10 and tool 12 forces the axle 20 through the vertical transition area 48 until the leg assemblies are on the ground and axle 20 is lodged below the work position 44 at the upper end of the J-shaped slot 40.

Referring to FIGS. 8-13, the structure and function of the stabilizing assembly 16 will be described in greater detail. With specific reference to FIGS. 8 and 9, a foot 50 is provided on the bottom of each of the front legs 28 and rear legs 30. Each of the feet 50 include a floor flange 52 that extends horizontally from beneath the legs 28 and 30. The floor flange 52 may extend on the outboard side of the legs 28 and 30, which is preferred, or alternatively, may extend inwardly. However, if they extend inwardly, the front stretcher 32 may interfere with the movement of the stabilizing assembly 16. An outer flange 54 may also be provided if desired to constrain the stabilizing assembly 16. However, it should be understood that the outer flange 54 could be eliminated since the leg assembly on the opposite side prevents movement in the inward direction toward the tool stand 10. The outer flange 54 and the front legs 28 need not be connected to the side rails by a connector.

The stabilizing assembly 16 includes a right side rail 56 and a left side rail 58 that extend from beneath the tool stand 10 forwardly toward the front side of the portable tool stand assembly 10. The right and left side rails 56 and 58 are connected to opposite ends of the foot rail 60, or longitudinally extending rail. The right and left side rails 56 and 58 may be pivotally connected by a bolt (not shown) to opposite ends of the foot rail 60. The right and left side rails 56 and 58 are connected to the right leg assembly 24 and left leg assembly 26, respectively.

Figure 8:
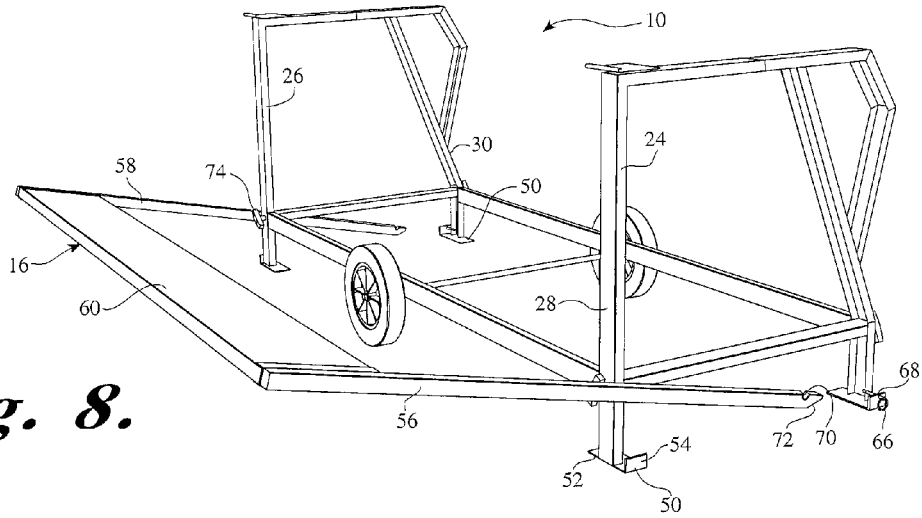
FIG. 8 is a perspective view of a stabilizing assembly that is disassembled from the portable tool stand.
Figure 9:
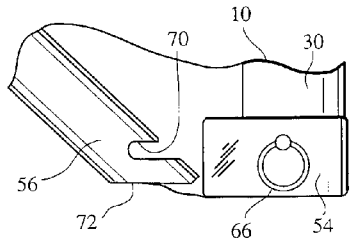
FIG. 9 is a fragmentary side elevation view of one end of a side rail detached from the portable tool stand.

A locking pin 66, or connector, is received in a hole 68 formed in the outer flange 54 that also extends through the bottom of the rear leg 30. As shown best in FIG. 9, a slot 70 is formed in the upper surface of the side rails 56 and 58. The side rails 56 and 58 include a beveled end 72 that facilitates inserting the side rails 56 and 58 underneath the locking pin 66 until the locking pin 66 is received within the slot 70. As shown in FIGS. 8 and 9, the stabilizing assembly 16 is separated from the rear feet 50, but the side rails 56 and 58 are aligned so that the beveled end 72 of each of the side rails 56 and 58 may be inserted under the locking pin 66.

Figure 10:
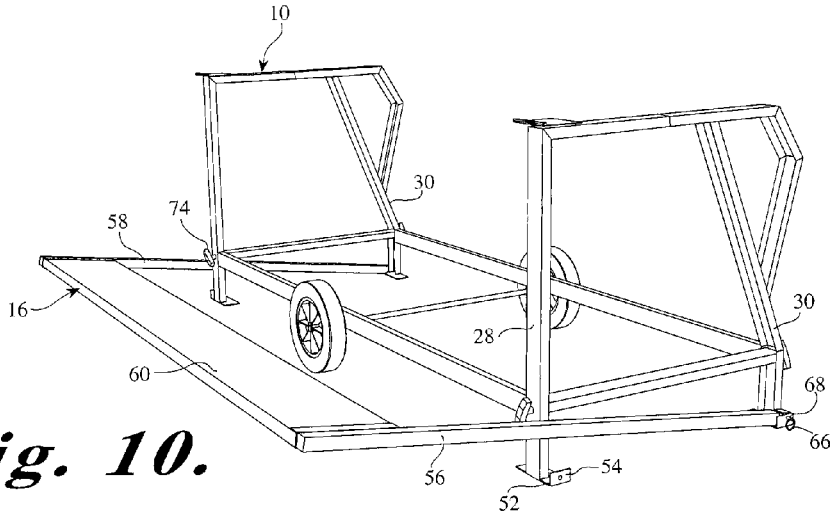
FIG. 10 is a perspective view of the stabilizing assembly partially attached to the portable tool stand.
Figure 11:
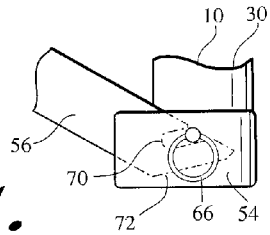
FIG. 11 is a fragmentary side elevation view of one end of the side rail initially engaging the portable tool stand.

Referring to FIGS. 10 and 11, the stabilizing assembly 16 is shown pivoted upwardly relative to the front feet 50, but the locking pin 66 is positioned within the slot 70. The slot 70 and beveled end 72 are not visible in FIG. 10, but are illustrated in phantom lines in FIG. 11.

Figure 12:
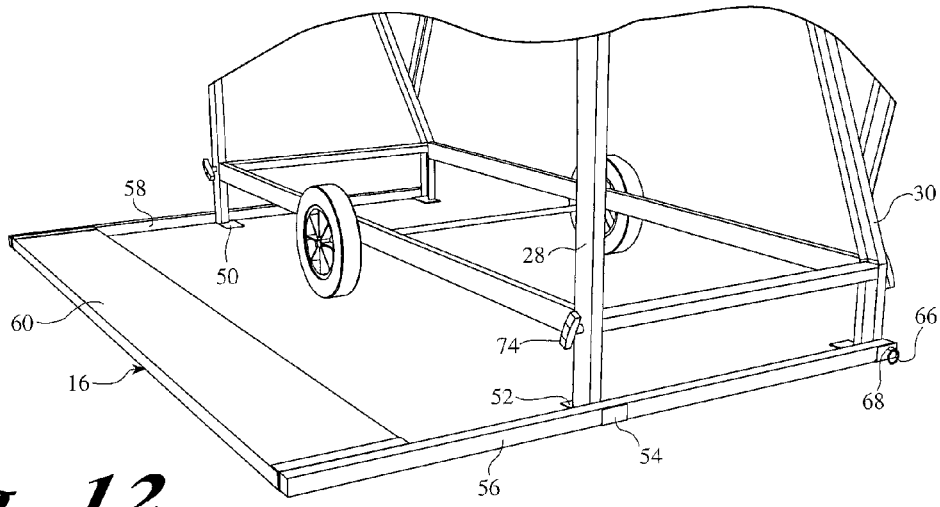
FIG. 12 is a fragmentary perspective view of the stabilizing assembly fully attached to the portable tool stand.
Figure 13:
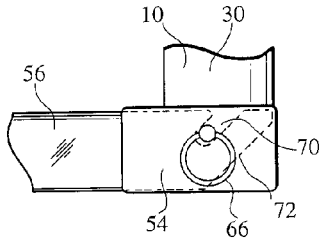
FIG. 13 is a fragmentary side elevation view of one end of the side rail secured with a locking pin to the portable tool stand.

Referring to FIG. 12, the stabilizing assembly 16 is shown fully installed on the tool stand assembly 10 with the side rails 56 and 58 being received on the floor flanges 52 of the feet 50. The right and left side rails 56 and 58 engage the floor flanges 52 of the front legs 28, but are not otherwise secured to the feet 50 of the front legs 28. It will be appreciated that the stabilizing assembly 16 may be assembled to the tool stand assembly 10 without the use of any tools. As shown in FIGS. 12 and 13, the locking pin 66 need not be removed or reattached to the feet 50 on the rear legs 30 because the rail may be simply slipped underneath the locking pin 66. It will also be appreciated that it is not necessary to lift either end of the portable tool stand assembly 10 off of the ground to attach or detach the tool stand assembly 10 from the stabilizing assembly 16. Since the combined weight of the tool stand assembly 10 and tool 12 may be several hundred pounds, this feature makes assembling the stabilizing assembly 16 to the portable tool stand assembly 10 much easier.

T-knobs 74 are provided to attach the right and left leg assemblies 24 and 26 to the front stretcher 32 and rear stretcher 34. The T-knobs 74 may be removed to permit the leg assemblies 24 and 26 to be removed from the tool stand assembly 10. The portable tool stand assembly 10 may be moved more easily and stored in a more compact area with the right and left leg assemblies 24 and 26 removed. The stabilizing assembly 16 is removed before the leg assemblies 24 and 26 can be removed for storage. While the stabilizing assembly 16 is primarily provided to stabilize the tool stand assembly 10 when the sheet metal bending brake is operated, the right and left side rails 56 and 58 also reinforce the tool stand assembly 10 against lateral displacement of the right and left leg assemblies 24 and 26.

While exemplary embodiments are described above, it is not intended that these embodiments describe all possible forms of the invention. Rather, the words used in the specification are words of description rather than limitations, and it is understood that various changes may be made without departing from the spirit and scope of the invention. Additionally, the features of various implementing embodiments may be combined to form further embodiments of the invention.

What is claimed is:

1. A portable tool stand assembly for supporting a tool on a ground surface comprising:

an elongated stand having opposite ends at spaced longitudinal locations, the stand includes a right leg assembly and a left leg assembly that have bottom ends that selectively engage the ground surface, wherein the leg assemblies each include a front leg and a rear leg;

a right side rail and a left side rail that are connected by a right connector and a left connector to the rear legs of the right and left leg assemblies, respectively, and extend from the right and left leg assemblies to a front side of the tool stand, wherein each of the right side rail and the left side rail have a receptacle that receives one of the right and left connectors, and wherein a flange is provided on each of the front legs that engages a bottom surface of the right and left side rails but is otherwise not secured to the side rails; and a foot rail operatively connected between the right and left side rails, wherein the foot rail may be lifted to raise the right and left side rails off of the flanges and pivoted about the connectors to disengage the connectors from the receptacles without removing the connectors from the rear legs;

a pair of wheels are attached to the stand at a location that is between the opposite ends of the stand, wherein the wheels may be lowered vertically relative to the stand and fixed in a mobile position in which the stand is raised to facilitate rolling the stand along the ground surface and wherein the wheels may be raised vertically relative to the stand and fixed in a work position with the bottom ends of the leg assemblies engaging the ground surface.

2. The tool stand assembly of claim 1 wherein the leg assemblies are connected by a stretcher that extends between the leg assemblies, and wherein the pair of wheels are attached to a middle portion of the stretcher.

3. The tool stand assembly of claim 2 wherein the stretcher is a front stretcher that extends between the front legs and wherein a rear stretcher is provided that extends between the rear legs of the leg assemblies.

4. The tool stand assembly of claim 3 wherein the wheels are attached to the front stretcher and the rear stretcher by at least two plates that each defines a J-shaped slot that provides the mobile position at a lower end of the J-shaped slot and the work position below an upper end of the J-shaped slot.

5. The tool stand assembly of claim 1 wherein the wheels are attached by a plate that defines a J-shaped slot that provides the mobile position at a lower end of the J-shaped slot and the work position below an upper end of the J-shaped slot.

6. The tool stand assembly of claim 1 wherein the tool is a bending brake.

7. The tool stand assembly of claim 1 wherein the tool is a saw table.

8. The tool stand assembly of claim 1 wherein the wheels are attached to the stand by an axle that is received in a bracket that defines a receptacle that includes a first axle receiving area that is at a first height above the bottom ends of the leg assemblies when the receptacle receives the axle in the mobile position, and a second axle receiving area that is at a second height above the bottom ends of the leg assemblies when the receptacle receives the axle in the work position, wherein the first height is lower than the second height.

9. A portable tool stand for supporting a tool to be operated by an operator comprising:

a right leg assembly and a left leg assembly that have bottom ends that engage a ground surface and that support the tool at a raised level, the two leg assemblies each include a rear leg and a front leg;

a right side rail and a left side rail that are connected by a right pin and a left pin to the rear legs of the right and left leg assemblies, respectively, and extend from the right and left leg assemblies to a front side of the tool stand, wherein each of the right side rail and the left side rails define a slot in a top surface of each of the right and left side rails that receives one of the right and left pins, and wherein a flange is provided on each of the front legs that engages a bottom surface of the right and left side rails but is otherwise not secured to the side rails; and a foot rail operatively connected between the right and left side rails, wherein the side rails each have a relief bevel on an end opposite the foot rail that provides clearance for the right and left rails to be pivoted about the pins and free of the flanges to remove the right and left side rails and the foot rail from the tool stand.

10. A portable tool stand for supporting a tool to be operated by an operator comprising:

a right leg assembly and a left leg assembly that have bottom ends that engage a ground surface and that support the tool at a raised level, the right and left leg assemblies each include a rear leg and a front leg;

a right side rail and a left side rail that are connected by a right connector and a left connector to the rear legs of the right and left leg assemblies, respectively, and extend from the right and left leg assemblies to a front side of the tool stand, wherein each of the right side rail and the left side rail have a receptacle that receives one of the right and left connectors, and wherein a flange is provided on each of the front legs that engages a bottom surface of the right and left side rails but is otherwise not secured to the side rails; and a foot rail operatively connected between the right and left rails, wherein the foot rail may be lifted to raise the right and left side rails off of the flanges and pivoted about the connectors to disengage the connectors from the receptacles without removing the connectors from the rear legs.

11. The portable tool stand of claim 10 wherein the right side rail and the left side rail are connected laterally adjacent the front and rear legs of the right and left leg assemblies and may be attached to and detached from the tool stand without lifting the tool stand off of the ground.

* * * * *